US009639057B2

(12) United States Patent
Jung

(10) Patent No.: US 9,639,057 B2
(45) Date of Patent: May 2, 2017

(54) WEARABLE WATCH TYPE MOBILE TERMINAL

(71) Applicant: LG ELECTRONICS INC., Seoul (KR)

(72) Inventor: Dawoon Jung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 155 days.

(21) Appl. No.: 14/723,101

(22) Filed: May 27, 2015

(65) Prior Publication Data

US 2016/0132023 A1 May 12, 2016

(30) Foreign Application Priority Data

Nov. 7, 2014 (KR) ..... 10-2014-0154503

(51) Int. Cl.

| | |
|---|---|
| ***A45F 5/00*** | (2006.01) |
| ***G04G 17/00*** | (2013.01) |
| ***G04B 37/00*** | (2006.01) |
| ***G04G 21/08*** | (2010.01) |
| ***B65H 18/00*** | (2006.01) |
| ***A44C 5/24*** | (2006.01) |
| ***G04G 17/06*** | (2006.01) |

(52) U.S. Cl.

CPC ..... *G04B 37/0008* (2013.01); *A44C 5/246* (2013.01); *B65H 18/00* (2013.01); *G04G 17/06* (2013.01); *G04G 21/08* (2013.01); *A45F 2005/008* (2013.01); *Y10T 24/2155* (2015.01); *Y10T 24/2187* (2015.01)

(58) Field of Classification Search

CPC ..... A61B 17/1325; A61B 5/681; A45F 2005/008; Y10T 24/4782; Y10T 24/2155; Y10T 24/2187; A43C 11/165; A63B 2220/836

USPC ..... 224/221, 176; 24/68 J, 265 WS

See application file for complete search history.

(56) References Cited

U.S. PATENT DOCUMENTS

| | | | | |
|---|---|---|---|---|
| 1,313,644 | A * | 8/1919 | Simon | A44C 5/22 224/176 |
| 1,692,079 | A * | 11/1928 | Alo | A44C 5/24 224/176 |
| 1,817,475 | A * | 8/1931 | Becker | A44C 5/22 224/176 |

(Continued)

FOREIGN PATENT DOCUMENTS

| | | |
|---|---|---|
| CH | 706904 | 3/2014 |
| JP | 2008-279061 | 11/2008 |

OTHER PUBLICATIONS

European Patent Office Application Serial No. 15183948.7, Search Report dated Mar. 30, 2016, 8 pages.

*Primary Examiner* — Justin Larson

(74) *Attorney, Agent, or Firm* — Lee, Hong, Degerman, Kang & Waimey

(57) ABSTRACT

A watch type mobile terminal includes: a body having a power supply unit, a printed circuit board, and a display unit formed to implement a touch input thereon; a band unit formed to be wearable on a user's wrist by being connected to the body, and formed such that at least part thereof is wound or unwound in the body; and a length control unit configured to implement winding or unwinding of the band unit such that a length of the band unit is controllable in accordance with a user's wrist size.

18 Claims, 14 Drawing Sheets

(56) References Cited

U.S. PATENT DOCUMENTS 3,890,801 A * 6/1975 Newman ..... A44C 5/22 224/176
5,485,848 A 1/1996 Jackson et al.
7,562,640 B2 * 7/2009 Lalor ..... A01K 27/009 119/719
7,618,384 B2 * 11/2009 Nardi ..... A61B 5/6828 601/101
7,752,774 B2 * 7/2010 Ussher ..... A43B 3/0005 36/100
8,147,417 B2 * 4/2012 Gavriely ..... A61B 17/1325 600/499
8,370,998 B2 * 2/2013 Han ..... A44B 11/008 24/265 WS
8,522,456 B2 * 9/2013 Beers ..... A43B 3/0005 24/68 SK
8,769,844 B2 * 7/2014 Beers ..... A43B 3/0005 36/50.1
9,044,372 B2 * 6/2015 Wild ..... A61H 9/0071
9,129,503 B2 * 9/2015 Borlenghi ..... G08B 21/0269
9,144,273 B2 * 9/2015 Wu ..... A44C 5/18
9,204,690 B1 * 12/2015 Alt ..... A43C 11/20
9,307,804 B2 * 4/2016 Beers ..... A43B 3/0005
9,365,387 B2 * 6/2016 Beers ..... A61F 5/028
2004/0025984 A1 * 2/2004 Holemans ..... A44C 5/0092 148/563
2007/0125816 A1 * 6/2007 Myers ..... A44C 5/0007 224/221
2008/0060224 A1 * 3/2008 Whittlesey ..... A43B 3/0005 36/88
2008/0086911 A1 * 4/2008 Labbe ..... A43B 11/00 36/50.1
2010/0302914 A1 12/2010 Faucher et al.
2012/0102691 A1 5/2012 Han et al.
2014/0070042 A1 * 3/2014 Beers ..... A61F 5/028 242/413
2014/0094728 A1 * 4/2014 Soderberg ..... A61F 5/028 602/6
2015/0135410 A1 * 5/2015 Wu ..... A44C 5/18 2/338
2016/0132023 A1 * 5/2016 Jung ..... G04B 37/0008 368/282
2016/0255944 A1 * 9/2016 Baranski ..... A44C 5/0069
2016/0272458 A1 * 9/2016 Beers ..... A61F 5/028
2016/0345653 A1 * 12/2016 Beers ..... A43B 3/0005
2016/0345661 A1 * 12/2016 Beers ..... A43B 13/14

* cited by examiner

WEARABLE WATCH TYPE MOBILE TERMINAL

CROSS-REFERENCE TO RELATED APPLICATION

Pursuant to 35 U.S.C. §119(a), this application claims the benefit of earlier filing date and right of priority to Korean Application No. 10-2014-0154503, filed on Nov. 7, 2014, the contents of which is incorporated by reference herein in its entirety.

BACKGROUND OF THE INVENTION

1. Field of the Invention

This specification relates to a mobile terminal, and more particularly, to a watch type mobile terminal which is wearable on a user's wrist.

2. Background of the Invention

Terminals may be generally classified as mobile/portable terminals or stationary terminals according to their mobility. Mobile terminals may also be classified as handheld terminals or vehicle mounted terminals according to whether or not a user can directly carry the terminal.

Mobile terminals have become increasingly more functional. Examples of such functions include data and voice communications, capturing images and video via a camera, recording audio, playing music files via a speaker system, and displaying images and video on a display. Some mobile terminals include additional functionality which supports game playing, while other terminals are configured as multimedia players. More recently, mobile terminals have been configured to receive broadcast and multicast signals which permit viewing of content such as videos and television programs.

As functions of the terminal become more diversified, the terminal can support more complicated functions such as capturing images or video, reproducing music or video files, playing games, receiving broadcast signals, and the like. By comprehensively and collectively implementing such functions, the mobile terminal may be embodied in the form of a multimedia player or a device.

Various attempts have been made to implement complicated functions in such a multimedia device by means of hardware or software.

Recently, a wearable mobile terminal, which is formed to be wearable on a user's body and configured to provide information and to collect information even when the user is in an unconscious state, is being developed. Especially, in case of a watch type mobile terminal wearable on a user's wrist, the user's inconvenience to hold the mobile terminal using his or her hand is minimized. Further, the watch type mobile terminal may provide information real time, to a user who wears the watch type mobile terminal.

Such a wearable type mobile terminal is worn on a user's body. Thus, wearability as well as performance of the wearable type mobile terminal is considered as an important element. A user may have uncomfortable feeling when wearing the watch type mobile terminal, since each user has a different body size.

For instance, a man's average wrist length (a length of an outer circumferential surface of the wrist) is about 17~18 cm, whereas a woman's average wrist length is about 15~16 cm. Accordingly, there is a difference of about 2 cm between the man's average wrist length and the woman's average wrist length. If a watch type mobile terminal fabricated for a man's wrist is worn on a woman's wrist, it may be too large. On the other hand, if a watch type mobile terminal fabricated for a woman's wrist is worn on a man's wrist, it may be too small. Further, a difference in average wrist lengths may be 6 cm at maximum. Thus, if a user wears a watch type mobile terminal not suitable for himself or herself, the user may have discomfort.

Accordingly, research on a mobile terminal which allows a user to wear the mobile terminal without any discomfort, regardless of his or her body size, is required.

SUMMARY OF THE INVENTION

Therefore, an aspect of the detailed description is to provide a watch type mobile terminal capable of controlling a length of a band unit according to a user's body size.

Another aspect of the detailed description is to provide a watch type mobile terminal capable of easily controlling a length of a band unit without complicated manipulation.

Another aspect of the detailed description is to provide a watch type mobile terminal capable of providing various mechanisms for controlling a length of a band unit.

To achieve these and other advantages and in accordance with the purpose of this specification, as embodied and broadly described herein, there is provided a watch type mobile terminal, including: a body having a power supply unit, a printed circuit board, and a display unit formed to implement a touch input thereon; a band unit formed to be wearable on a user's wrist by being connected to the body, and formed such that at least part thereof is wound or unwound in the body; and a length control unit configured to implement winding or unwinding of the band unit such that a length of the band unit is controllable in accordance with a user's wrist size.

In an embodiment of the present invention, the band unit may include a first band connected to at least one of one side and another side of the body, and composed of a plurality of nodes; and a second band extending to at least one of the one side and the another side of the body by being inserted into the first band partially or wholly, and formed of a flexible material so as to be wound or unwound by the length control unit.

The length control unit may further include a gear bar rotatably installed in the body, the gear bar connected to the second band so as to wind or unwind the second band thereon or therefrom according to a rotation direction thereof.

The length control unit may further include a motor connected to a rotational shaft of the gear bar so as to rotate the gear bar.

The motor may be rotated or stopped based on a user's input, such that a length of the band unit is controllable to a preset length.

The watch type mobile terminal may further include a proximity illumination sensor installed on a rear surface of the body, and the motor may be rotated or stopped based on change of a distance between a user's wrist and the body, the distance change sensed by the proximity illumination sensor.

The length control unit may further include a spiral spring connected to the second band and the gear bar, respectively. For length control of the band unit, the spiral spring may be unwound from the gear bar by a force to pull the second band, and may be wound on the gear bar when the force to pull the second band is removed.

The length control unit may further include a stopping portion formed to be pushable by being exposed to outside of the body or the band unit. The stopping portion may be configured to press the second band when pushed by an external force, to thus restrict movement of the second band.

The length control unit may include a stopping gear rotated together with the gear bar; a locking portion disposed to correspond to the stopping gear, and formed to be locked to the stopping gear such that re-winding of the spiral spring is restricted; a push button formed at the body or the band unit so as to be pushable, and configured to move the stopping gear so as to separate the stopping gear from the locking portion when it is pushed by an external force; and an elastic member disposed on an opposite side to the push button on the basis of the stopping gear, for support of the stopping gear, the elastic member configured to return the stopping gear to an initial position prior to movement when the external force applied to the push button is removed.

The watch type mobile terminal may further include a flexible printed circuit board electrically connected to electronic components inside the body, and extending up to inside of the first band. The length control unit may further include a push switch formed to be pushable as at least part thereof is exposed to outside of the band unit. The push switch may be electrically connected to the flexible printed circuit board, and may generate a signal to wind or unwind the second band according to a push input.

In another embodiment of the present invention, the watch type mobile terminal may further include a bio sensor installed on a rear surface of the body or one surface of the band unit, and configured to sense a user's bio information. The bio sensor may be arranged to face a user's body as length control of the band unit by the length control unit is completed.

In another embodiment of the present invention, the body may include a first body having the power supply unit, the printed circuit board and the display unit; and a second body connected to the first body by the band unit, and having the length control unit.

The length control unit may include a spiral spring rotatably installed in the second body. The band unit may be connected to the spiral spring, as one end thereof is connected to the first body and anther end thereof is inserted into the second body.

At least part of the band unit may be formed of a conductive material, such that electronic components inside the first body are electrically connected to electronic components inside the second body. A non-conductive material may be coated on the surface of the band unit.

The length control unit may further include a winding gear connected to a rotational shaft of the spiral spring, so as to be rotated together with the spiral spring; and a winding motor connected to the winding gear so as to provide a rotational force to the winding gear.

The length control unit may include an unwinding gear installed at the rotational shaft of the spiral spring, so as to be rotated together with the spiral spring, and having a groove on an outer circumferential surface thereof; a locking member formed to be rotatable, and inserted into the groove with a preset range of rotation angle, such that rotation of the spiral spring is restricted; and an unwinding motor connected to a rotational shaft of the locking member so as to rotate the locking member.

The length control unit may further include a supporting portion formed to contact the rotational shaft of the spiral spring, and formed of a conductive material partially or wholly; and a cable electrically connected to the winding motor or the unwinding motor and the supporting portion, such that an electric signal transmitted from the first body through the band unit is provided to the winding motor or the unwinding motor. The winding motor or the unwinding motor may be rotated based on an electric signal transmitted through the cable.

The second body may be provided with a hole corresponding to the locking member. The locking member may be separated from the groove by being pressed by an external object inserted through the hole. The length control unit may further include an elastic member disposed at an opposite side to the hole on the basis of the locking member, for support of the locking member. The elastic member may restore the locking member to an initial position prior to movement, when the external force by the external object is removed.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail according to exemplary embodiments disclosed herein, with reference to the accompanying drawings. For the sake of brief description with reference to the drawings, the same or equivalent components may be provided with the same or similar reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. In the present disclosure, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

It will be understood that although the terms first, second, etc. may be used herein to describe various elements, these elements should not be limited by these terms. These terms are generally only used to distinguish one element from another.

It will be understood that when an element is referred to as being "connected with" another element, the element can be connected with the other element or intervening elements may also be present. In contrast, when an element is referred to as being "directly connected with" another element, there are no intervening elements present.

A singular representation may include a plural representation unless it represents a definitely different meaning from the context.

Terms such as "include" or "has" are used herein and should be understood that they are intended to indicate an existence of several components, functions or steps, disclosed in the specification, and it is also understood that greater or fewer components, functions, or steps may likewise be utilized.

Figure 1:
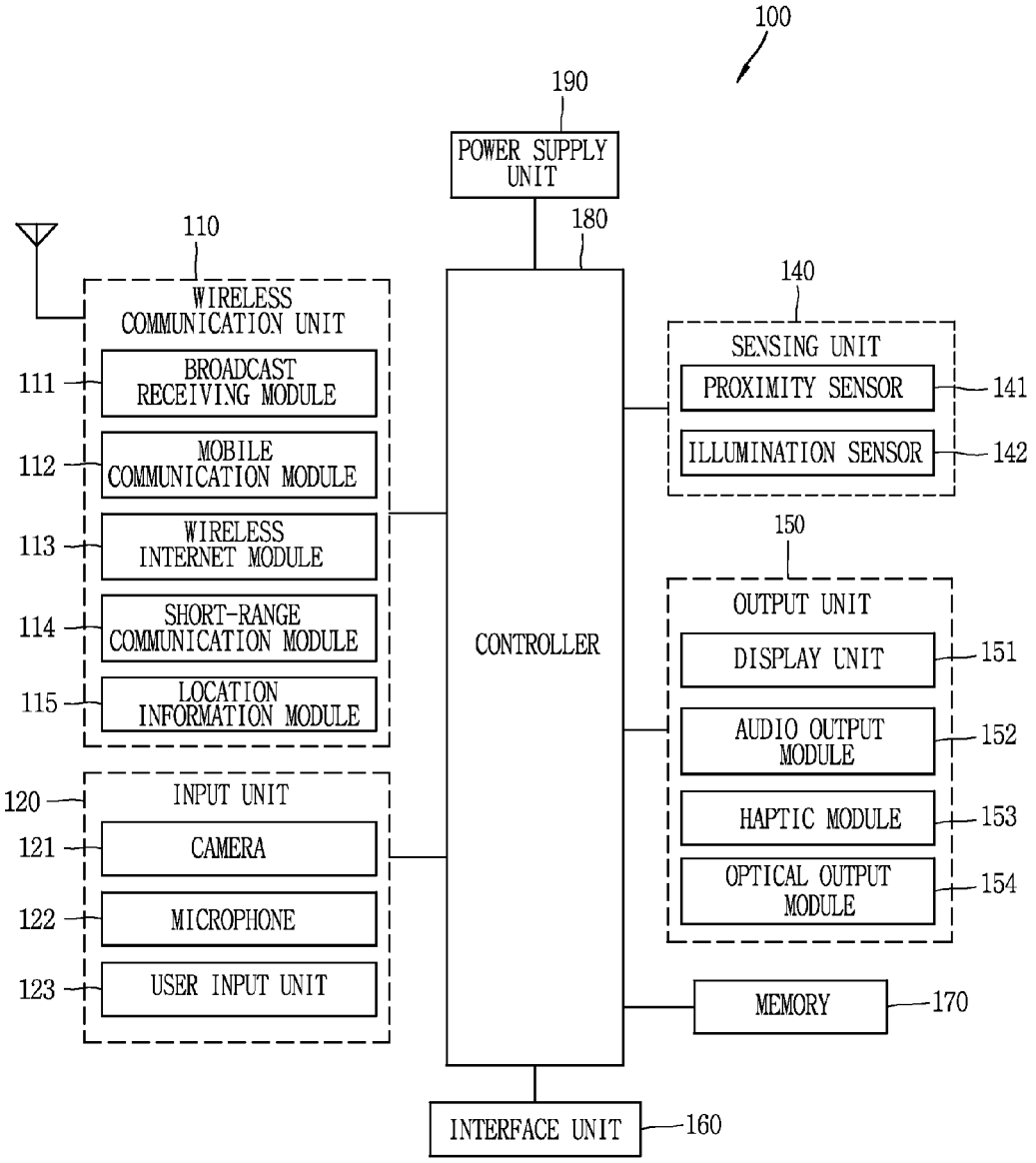
FIG. 1 is a block diagram of a mobile terminal according to the present invention.

FIG. 1 is a block diagram of a mobile terminal 100 according to an embodiment of the present invention.

The mobile terminal 100 is shown having components such as a wireless communication unit 110, an input unit 120, a sensing unit 140, an output unit 150, an interface unit 160, a memory 170, a controller 180, and a power supply unit 190. It is understood that implementing all of the illustrated components is not a requirement, and that greater or fewer components may alternatively be implemented.

Referring now to FIG. 1, the wireless communication unit 110 typically includes one or more components which permit wireless communication between the mobile terminal 100 and a wireless communication system or network within which the mobile terminal is located.

The wireless communication unit 110 typically includes one or more modules which permit communications such as wireless communications between the mobile terminal 100 and a wireless communication system, communications between the mobile terminal 100 and another mobile terminal, communications between the mobile terminal 100 and an external server. Further, the wireless communication unit 110 typically includes one or more modules which connect the mobile terminal 100 to one or more networks.

To facilitate such communications, the wireless communication unit 110 includes one or more of a broadcast receiving module 111, a mobile communication module 112, a wireless Internet module 113, a short-range communication module 114, and a location information module 115.

The input unit 120 includes a camera 121 for obtaining images or video, a microphone 122, which is one type of audio input device for inputting an audio signal, and a user input unit 123 (for example, a touch key, a push key, a mechanical key, a soft key, and the like) for allowing a user to input information. Data (for example, audio, video, image, and the like) is obtained by the input unit 120 and may be analyzed and processed by controller 180 according to device parameters, user commands, and combinations thereof.

The sensing unit 140 is typically implemented using one or more sensors configured to sense internal information of the mobile terminal, the surrounding environment of the mobile terminal, user information, and the like. For example, in FIG. 1, the sensing unit 140 is shown having a proximity sensor 141 and an illumination sensor 142. If desired, the sensing unit 140 may alternatively or additionally include other types of sensors or devices, such as a touch sensor, an acceleration sensor, a magnetic sensor, a G-sensor, a gyroscope sensor, a motion sensor, an RGB sensor, an infrared (IR) sensor, a finger scan sensor, a ultrasonic sensor, an optical sensor (for example, camera 121), a microphone 122, a battery gauge, an environment sensor (for example, a barometer, a hygrometer, a thermometer, a radiation detection sensor, a thermal sensor, and a gas sensor, among others), and a chemical sensor (for example, an electronic nose, a health care sensor, a biometric sensor, and the like), to name a few. The mobile terminal 100 may be configured to utilize information obtained from sensing unit 140, and in particular, information obtained from one or more sensors of the sensing unit 140, and combinations thereof.

The output unit 150 is typically configured to output various types of information, such as audio, video, tactile output, and the like. The output unit 150 is shown having a display unit 151, an audio output module 152, a haptic module 153, and an optical output module 154.

The display unit 151 may have an inter-layered structure or an integrated structure with a touch sensor in order to facilitate a touch screen. The touch screen may provide an output interface between the mobile terminal 100 and a user, as well as function as the user input unit 123 which provides an input interface between the mobile terminal 100 and the user.

The interface unit 160 serves as an interface with various types of external devices that can be coupled to the mobile terminal 100. The interface unit 160, for example, may include any of wired or wireless ports, external power supply ports, wired or wireless data ports, memory card ports, ports for connecting a device having an identification module, audio input/output (I/O) ports, video I/O ports, earphone ports, and the like. In some cases, the mobile terminal 100 may perform assorted control functions associated with a connected external device, in response to the external device being connected to the interface unit 160.

The memory 170 is typically implemented to store data to support various functions or features of the mobile terminal 100. For instance, the memory 170 may be configured to store application programs executed in the mobile terminal 100, data or instructions for operations of the mobile terminal 100, and the like. Some of these application programs may be downloaded from an external server via wireless communication. Other application programs may be installed within the mobile terminal 100 at time of manufacturing or shipping, which is typically the case for basic functions of the mobile terminal 100 (for example, receiving a call, placing a call, receiving a message, sending a message, and the like). It is common for application programs to be stored in the memory 170, installed in the mobile terminal 100, and executed by the controller 180 to perform an operation (or function) for the mobile terminal 100.

The controller 180 typically functions to control overall operation of the mobile terminal 100, in addition to the operations associated with the application programs. The controller 180 may provide or process information or functions appropriate for a user by processing signals, data, information and the like, which are input or output by the various components depicted in FIG. 1, or activating application programs stored in the memory 170. As one example, the controller 180 controls some or all of the components illustrated in FIG. 1 according to the execution of an application program that have been stored in the memory 170.

The power supply unit 190 can be configured to receive external power or provide internal power in order to supply appropriate power required for operating elements and components included in the mobile terminal 100. The power supply unit 190 may include a battery, and the battery may be configured to be embedded in the terminal body, or configured to be detachable from the terminal body.

At least part of the above components may cooperate with each other, so as to control an operation of a mobile terminal according to various embodiments to be explained later. A method of controlling a mobile terminal may be implemented on the mobile terminal, by driving at least one application program stored in the memory 170.

In accordance with still further embodiments, a mobile terminal may be configured as a device which is wearable on a human body. Such devices go beyond the usual technique of a user grasping the mobile terminal using their hand. Examples of the wearable device include a smart watch, a smart glass, a head mounted display (HMD), and the like.

A typical wearable device can exchange data with (or cooperate with) another mobile terminal 100. In such a device, the wearable device generally has functionality that is less than the cooperating mobile terminal. For instance, the short-range communication module 114 of a mobile terminal 100 may sense or recognize a wearable device that is near-enough to communicate with the mobile terminal. In addition, when the sensed wearable device is a device which is authenticated to communicate with the mobile terminal 100, the controller 180 may transmit data processed in the mobile terminal 100 to the wearable device via the short-range communication module 114, for example. Hence, a user of the wearable device can use the data processed in the mobile terminal 100 on the wearable device. For example, when a call is received in the mobile terminal 100, the user can answer the call using the wearable device. Also, when a message is received in the mobile terminal 100, the user can check the received message using the wearable device.

Figure 2:
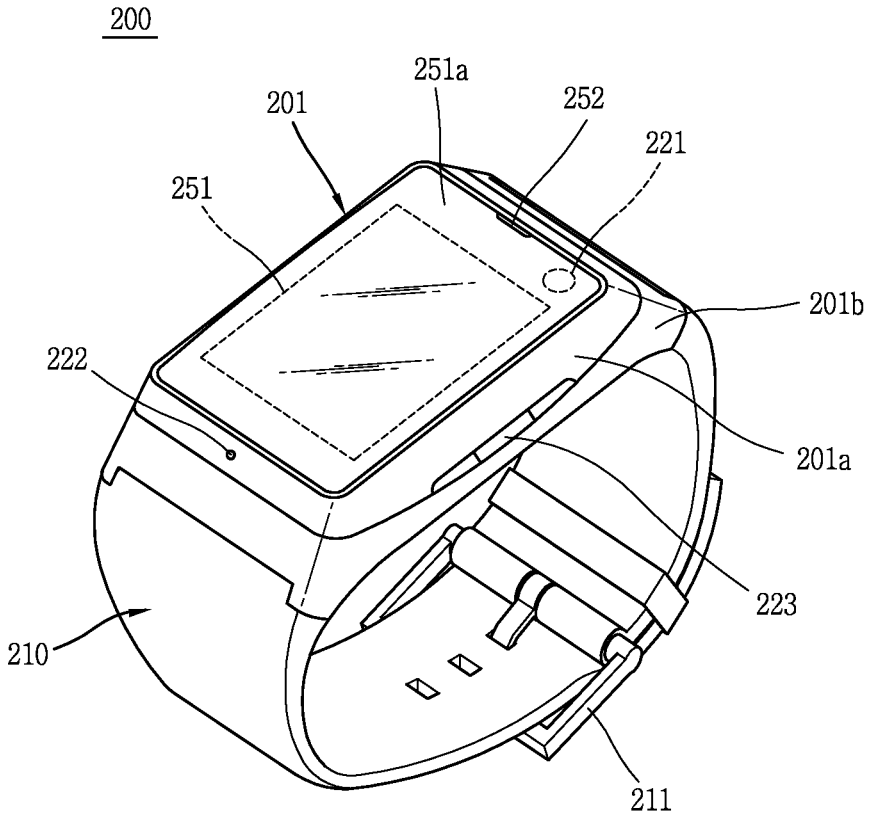
FIG. 2 is a perspective view of a watch type mobile terminal according to the present invention.

FIG. 2 is a perspective view illustrating one example of a watch-type mobile terminal 200 in accordance with another exemplary embodiment. As illustrated in FIG. 2, the watch-type mobile terminal 200 includes a main body 201 and a band unit 210 connected to the main body 201 to be wearable on a wrist. In general, mobile terminal 200 may be configured to include features that are the same or similar to that of mobile terminal 100 of FIG. 1.

The main body 201 may be provided with a power supply unit (not shown), a printed circuit board (not shown), and a display unit 251 configured to implement a touch input thereon. The main body 201 includes cases 201*a*, 201*b* having a certain appearance. As illustrated, the case may include a first case 201*a* and a second case 201*b* cooperatively defining an inner space for accommodating various electronic components. Other configurations are possible. For instance, a single case may alternatively be implemented, with such a case being configured to define the inner space, thereby implementing a mobile terminal 200 with a uni-body.

The watch-type mobile terminal 200 can perform wireless communication, and an antenna for the wireless communication can be installed in the main body 201. The antenna may extend its function using the case. For example, a case including a conductive material may be electrically connected to the antenna to extend a ground area or a radiation area.

The display unit 251 is shown located at the front side of the main body 201 so that displayed information is viewable to a user. In some embodiments, the display unit 251 includes a touch sensor so that the display unit can function as a touch screen. As illustrated, window 251*a* is positioned on the first case 201*a* to form a front surface of the terminal body together with the first case 201*a*.

The illustrated embodiment includes an audio output module 252, a camera 221, a microphone 222, and a user input unit 223 positioned on the main body 201. When the display unit 251 is implemented as a touch screen, additional function keys may be minimized or eliminated. For example, when the touch screen is implemented, the user input unit 223 may be omitted.

The band unit 210 is commonly worn on the user's wrist and may be made of a flexible material for facilitating wearing of the device. As one example, the band unit 210 may be made of fur, rubber, silicon, synthetic resin, or the like. The band unit 210 may also be configured to be detachable from the main body 201. Accordingly, the band unit 210 may be replaceable with various types of bands according to a user's preference.

In one configuration, the band unit 210 may be used for extending the performance of the antenna. For example, the band may include therein a ground extending portion (not shown) electrically connected to the antenna to extend a ground area.

The band unit 210 may include fastener 211. The fastener 211 may be implemented into a buckle type, a snap-fit hook structure, a Velcro® type, or the like, and include a flexible section or material. The drawing illustrates an example that the fastener 211 is implemented using a buckle.

Figure 3A:
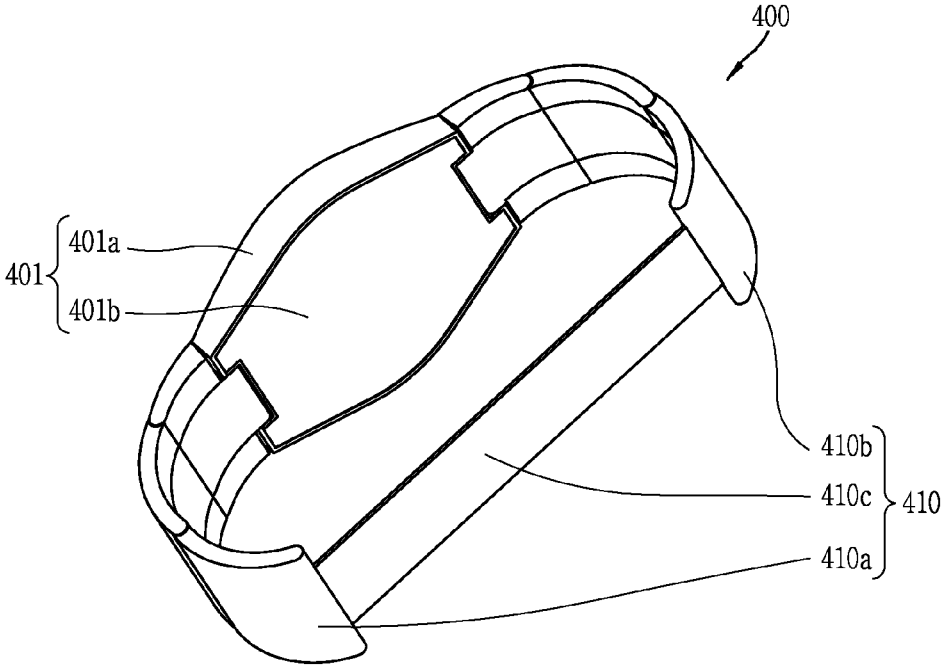
FIGS. 3A and 3B are perspective views illustrating states before and after a length of a band unit is controlled, respectively.
Figure 3B:
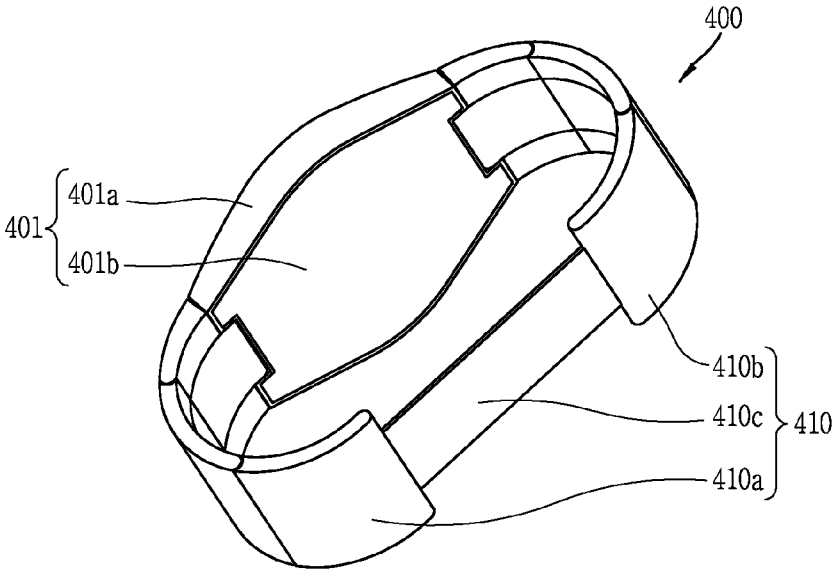

FIGS. 3A and 3B are perspective views illustrating states before and after a length of a band unit 410 is controlled, respectively.

Referring to FIGS. 3A and 3B, a body 401 is provided with a power supply unit (not shown), a printed circuit board (not shown), and a display unit configured to implement a touch input thereon. The body 401 includes a first case 401*a* and a second case 401*b*. An inner space for accommodating various types of electronic components is formed at the first case 401*a* and the second case 401*b*.

The band unit 410 is connected to the body 401, and is formed to be wearable on a user's wrist. For length control, the band unit 410 includes first bands 410*a*, 410*b* and a second band 410*c*.

The first bands 410*a*, 410*b* are connected to at least one of one side and another side of the body 401. The watch type mobile terminal 400 shown in FIGS. 3A and 3B includes two first bands 410*a*, 410*b*. One 410*a* of the two first bands 410*a*, 410*b* is connected to one side of the body 401, and another 410*b* of the two first bands 410*a*, 410*b* is connected to another side of the body 401.

However, the present invention is not limited to this. That is, the band unit 410 may include a single first band 410*a*.

If the band unit 410 includes a single first band 410*a*, the single first band 410*a* is connected to one side and another side of the body 401. Alternatively, the band unit 410 may include more than 3 first bands 410*a*, 410*b*, etc.

At least part of the second band 410*c* is inserted into the first bands 410*a*, 410*b*. The second band 410*c* may be configured to connect the two first bands 410*a*, 410*b* with each other. The second band 410*c* may be exposed between the two first bands 410*a*, 410*b*.

The first bands 410*a*, 410*b* may be formed of a metallic material. If the first bands 410*a*, 410*b* are formed of a metallic material, they are not easily deformed by an external force. The first bands may be composed of a plurality of nodes. Especially, if the first bands 410*a*, 410*b* are formed of a metallic material which is not easily deformed by an external force, the band unit 410 may be transformed so as to be most suitable for a user's wrist, as the number of the nodes of the first bands 410*a*, 410*b* is increased.

Unlike the first bands 410*a*, 410*b*, the second band 410*c* may be formed of a flexible material for length control. For instance, the second band 410*c* may be formed of fabric. In this case, unlike the first bands 410*a*, 410*b*, the second band 410*c* may not be composed of a plurality of nodes. However, the material of the second band 410*c* is not limited to fabric. That is, the second band 410*c* may be formed of a metallic material.

FIG. 3A illustrates a state before a length of the band unit 410 is controlled, and FIG. 3B illustrates a state after a length of the band unit 410 is controlled. In order for a user to wear the watch type mobile terminal 400 on his or her wrist, a length of the band unit 410 should be increased such that the watch type mobile terminal 400 is positioned on the wrist. Thus, FIG. 3A may be understood as a state where the length of the band unit 410 has been increased before a user wears the watch type mobile terminal 400.

On the contrary, after a user wears the watch type mobile terminal 400 on the wrist, the length of the band unit 410 should be controlled in correspondence to the wrist, such that the watch type mobile terminal 400 is prevented from being separated from the wrist. Thus, FIG. 3B may be understood as a state where the length of the band unit 410 has been decreased after a user wears the watch type mobile terminal 400.

Referring to FIGS. 3A and 3B, it can be checked that the length of the band unit 410 is changed as an area of the second band 410*c* exposed between the two first bands 410*a*, 410*b* is reduced.

In a case where the first bands 410*a*, 410*b* are formed of a different material from the second band 410*c*, integrated feeling in design may not be provided when the second band 410*c* is exposed between the two first bands 410*a*, 410*b*. For prevention of this, another configuration may be implemented. That is, the second band 410*c* may be configured to be exposed to outside only when the length of the band unit 410 is increased, but is not exposed to outside by being completely inserted into the two first bands 410*a*, 410*b* when the length of the band unit 410 is decreased.

In the watch type mobile terminal 400 of the present invention, since the length of the band unit 410 is controllable as shown in FIGS. 3A and 3B, a user may not have inconvenience in wearing the mobile terminal 400 regardless of his or her body size. Hereinafter, various mechanisms to control the length of the band unit 410 will be explained.

Figure 4:
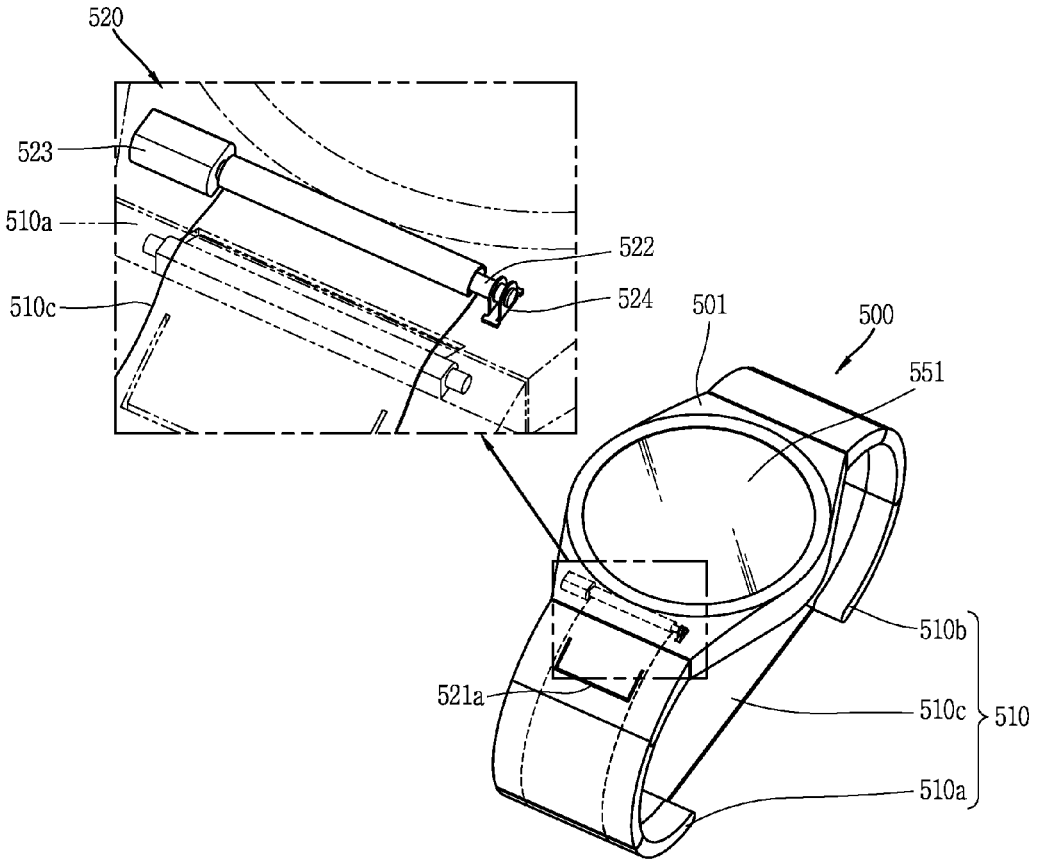
FIG. 4 is a conceptual view of a watch type mobile terminal according to an embodiment of the present invention.

FIG. 4 is a conceptual view of a watch type mobile terminal 500 according to an embodiment of the present invention.

Referring to FIG. 4, the watch type mobile terminal 500 includes a body 501, a band unit 510 and a length control unit 520.

The second band 510*c* is inserted into first bands 510*a*, 510*b* to thus extend up to one side or another side of the body 501. The second band 510*c* is formed to be wound or unwound in the body 501, by the length control unit 520. As aforementioned, the second band 510*c* is preferably formed of a flexible material so as to be wound or unwound by the length control unit 520.

The length control unit 520 is configured to wind or unwind the band unit 510 such that a length of the band unit 510 is controlled in correspondence to a user's wrist. FIG. 4 illustrates a mechanism and a structure to control the length of the band unit 510 in an electronic manner.

The length control unit 520 includes a gear bar 522, a motor 523.

The gear bar 522 is rotatably installed in the body 501. The gear bar 522 is connected to the second band 510*c*, so as to wind or unwind the second band 510*c* thereon or therefrom according to a rotation direction thereof. If the gear bar 522 is rotated to one direction, the second band 510*c* is wound on the gear bar 522. As a result, an area of the second band 510*c* exposed between the two first bands 510*a*, 510*b* is reduced, and the length of the band unit 510 is decreased.

On the contrary, if the gear bar 522 is rotated to another direction, the second band 510*c* is unwound from the gear bar 522. As a result, the area of the second band 510*c* exposed between the two first bands 510*a*, 510*b* is increased, and the length of the band unit 510 is increased.

The motor 523 is connected to a rotational shaft of the gear bar 522 so as to rotate the gear bar 522. The gear bar 522 is rotated by a rotational force provided from the motor 523. The motor 523 may be driven by a user's input, etc.

The length control unit 520 may further include a mounting plate 524 disposed on an opposite side to the motor 523, on the basis of the gear bar 522. The mounting plate 524 is formed to support the gear bar 522. Especially, since the gear bar 522 is rotatably installed, the mounting plate 524 fixed in the body 501 is relatively-rotatable with respect to the gear bar 522.

If a user applies a control command for controlling the length of the band unit 510 through the user input unit, after positioning the watch type mobile terminal 500 on his or her wrist, the length of the band unit 510 may be controlled based on the control command. The user input unit may be implemented by a display unit 551 having a touch input portion. The watch type mobile terminal 500 may provide a user interface for controlling the length of the band unit 510.

For instance, when a user applies a touch input to the display unit 551 or presses a push switch 521*a* of the watch type mobile terminal 500, a control command may be applied to the watch type mobile terminal 500. The motor 523 may be rotated based on the control command, and a rotation direction and a rotation angle of the motor 523 may be variable according to a user's input or a preset value. If the motor 523 is rotated, the gear bar 522 is rotated, and the second band 510*c* is wound on or unwound from the gear bar 522.

As a user re-touches the display unit 551, detaches his or her finger from the push switch 521*a*, or re-presses the push switch 521*a*, a control command may be re-applied. The motor 523 being rotated may be stopped by the re-input control command. The motor 523 may be controlled by the controller 180 (refer to FIG. 1), and the controller 180 may control a rotation direction, a rotation angle, etc. of the motor 523 based on a touch input or a push input.

The rotation direction and the rotation angle of the motor 523 may be preset.

After a user controls the length of the band unit 510 in accordance with his or her wrist size, the length of the band unit 510 may be stored in the memory 170 (refer to FIG. 1). The length of the band unit 510 may be variable, according to a rotation angle of the gear bar 522 from a reference position. If the gear bar 522 is rotated in a direction to wind the second band 510*c*, based on a state where the second band 510 has been completely unwound as the gear bar 522 is rotated, the length of the band unit 510 is decreased when the number of times of rotation of the gear bar 522 is increased. If the number of times of rotation of the gear bar 522, or a rotation angle of the gear bar 522 is determined based on a reference position, the length of the band unit 510 may be also determined. The controller 180 (refer to FIG. 1) may control rotation of the motor 523 based on a determined result.

If a user applies a control command to the watch type mobile terminal 500 after wearing the watch type mobile terminal 500 on his or her wrist, the motor 523 is rotated a preset number of times or by a preset angle. Thus, the length of the band unit 510 may be controlled in accordance with a pre-stored value with respect to a user's wrist. A pre-stored length of the band unit 510 may be variable according to a user's setting.

Under such a mechanism, a user needs not control the length of the band unit 510 every time. Since the length of the band unit 510 is set according to a user's wrist size, it may be controlled to a preset length according to a body size. If a user's body size is changed, the length of the band unit 510 may be newly set.

In an embodiment of FIG. 4, the length of the band unit 510 is not controlled physically, but is controlled through a user's input or a user interface. Thus, the method of controlling the length of the band unit 510 may be classified as an electronic type control method.

The push switch 521*a* will be explained in more detail with reference to FIGS. 5A and 5B.

Figure 5A:
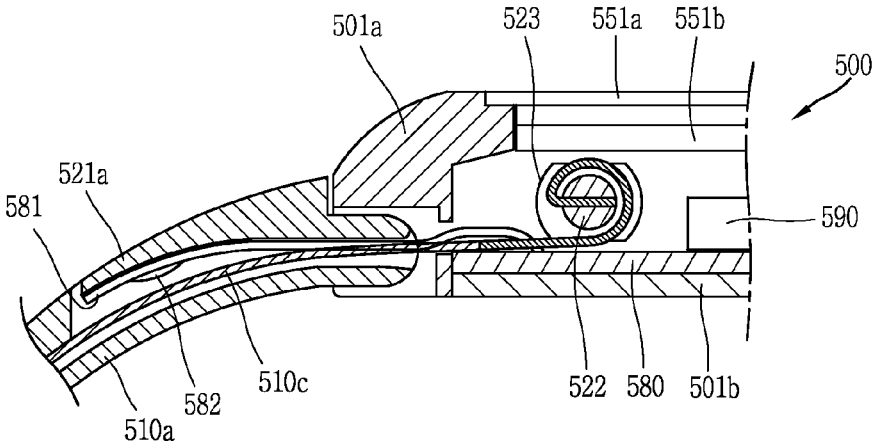
FIGS. 5A and 5B are sectional views illustrating a length control mechanism using a push switch.
Figure 5B:
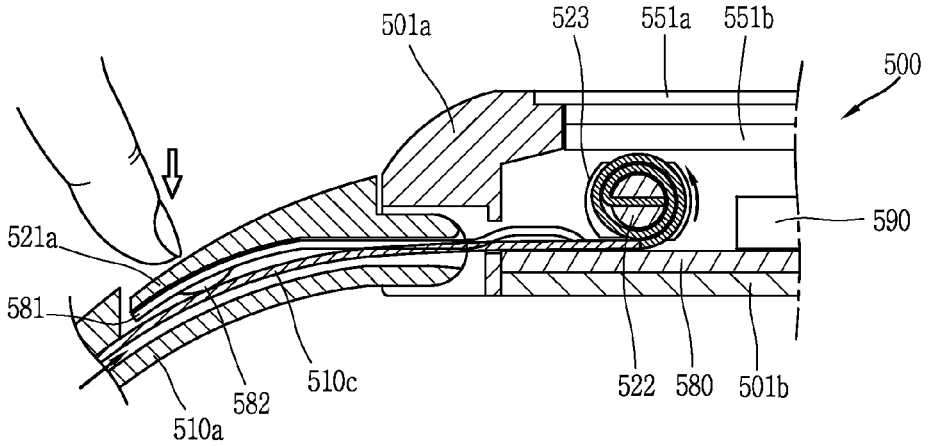

FIGS. 5A and 5B are sectional views illustrating a length control mechanism using the push switch 521*a*.

Various types of electronic components are mounted in bodies 501*a*, 501*b*. A window 551*a* forms a front surface of the bodies 501*a*, 501*b*, and protects a display panel 551*b*. The window 551*a* is formed of a transmissive material such that visual information provided from the display panel 551*b* is transmitted to a user.

A printed circuit board (PCB) 580 is installed in the bodies 501*a*, 501*b*. The PCB 580 includes components for controlling various types of operations of the watch type mobile terminal 500. The PCB 580 may be understood as the as controller 180 of FIG. 1.

A battery 590 provides power to each component of the watch type mobile terminal 500. The battery 590 is installed in the bodies 501*a*, 501*b*, in a replaceable manner. When a second case 501*b* is separated from a first case 501*a*, the PCB 580 is moved along the second case 501*b*, and the battery 590 is exposed to outside. The exposed battery 590 may be separated from the body 501, and may be replaced by another battery.

The PCB 580 is electrically connected to electronic components inside the bodies 501*a*, 501*b*. The electronic components inside the bodies 501*a*, 501*b* include the aforementioned PCB 580. A flexible PCB 581 extends up to inside of the first bands 510*a*, 510*b*.

The push switch 521*a* is a component to form the length control unit 520. The push switch 521*a* is formed to be pushable, and at least part thereof is exposed to outside of the bodies 501*a*, 501*b* or the band unit 510. The push switch 521*a* is electrically connected to the flexible PCB 581.

The push switch 521*a* is formed to receive an input for controlling the length of the band unit 510. The push switch 521*a* may be formed as at least part of the band unit 510 is cut. In this case, the push switch 521*a* may still provide an integrated feeling with another part of the band unit 510. If part of the push switch 521*a* exposed to an external surface of the band unit 510 is pressed, contact points come in contact with each other at a dome portion 582 formed below the push switch 521*a*. As a result, a signal for winding or unwinding the second band 510*c* is generated. The signal for winding or unwinding the second band 510*c* may be a signal for rotating the motor 523 in one direction, or in an opposite direction to the one direction.

FIG. 5A illustrates a state before the push switch 521*a* is pushed by a user. The gear bar 522 is in a stopped state.

FIG. 5B illustrates a state where the push switch 521*a* is pushed by a user. The gear bar 522 is rotated by a signal generated from the dome portion 582, and the second band 510*c* is wound on the gear bar 522.

The length of the band unit 510 may be controlled by the push switch 521*a*, as different signals are generated from the push switch 521*a*. The push switch 521*a* may set whether to rotate the gear bar 522 or not, or a rotation direction of the gear bar 522, according to the number of times that the push switch 521 is pushed, a time duration for which the push switch 521*a* is pushed, etc. For instance, if the push switch 521*a* is pushed, the gear bar 522 may be rotated so that the length of the band unit 510 can be controlled. On the contrary, if a user's finger is detached from the push switch 521*a*, the gear bar 522 may be stopped.

Figure 6:
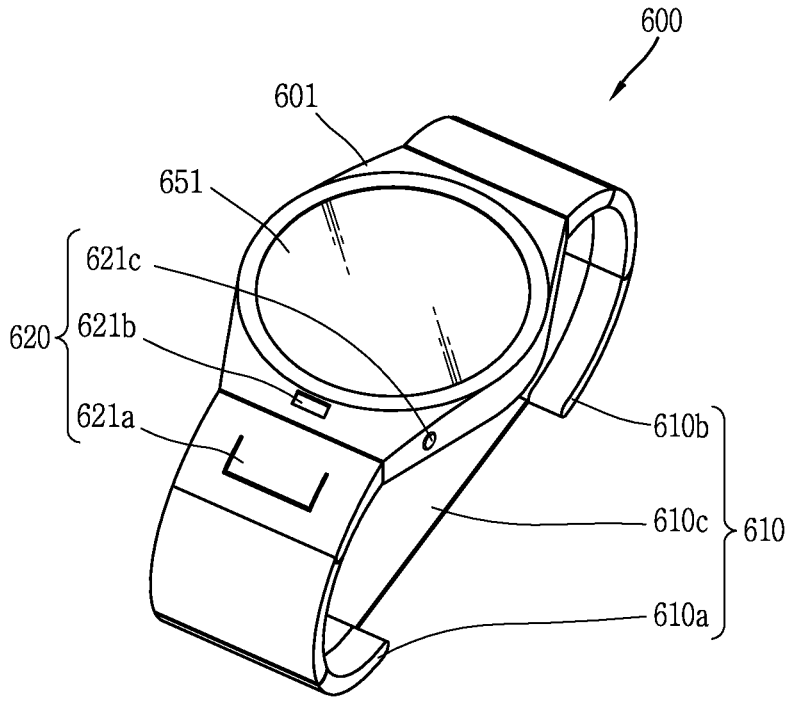
FIG. 6 is a perspective view of a watch type mobile terminal according to another embodiment of the present invention.

FIG. 6 is a perspective view of a watch type mobile terminal according to another embodiment of the present invention.

Referring to FIG. 6, the watch type mobile terminal 600 may include a stopping portion 621*b* and a push button 621*c*, as well as a push switch 621*a*. The stopping portion 621*b* and the push button 621*c* are exposed to outside of a body 601 or a band unit 610, for a user's manipulation.

In this embodiment, a mechanism of a length control unit 620 is a mechanical mechanism for controlling a length of the band unit 610 through physical manipulation. The push switch 621*a* will not be explained, since it has the same configuration as the aforementioned push switch. Hereinafter, only the stopping portion 621*b* and the push button 621*c* will be explained.

Figure 7:
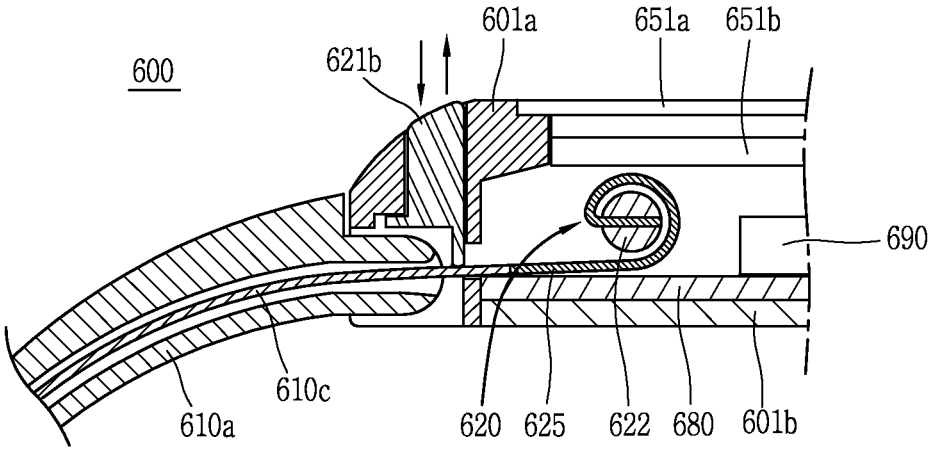
FIG. 7 is a sectional view illustrating a length control mechanism using a stopping portion.
Figure 8A:
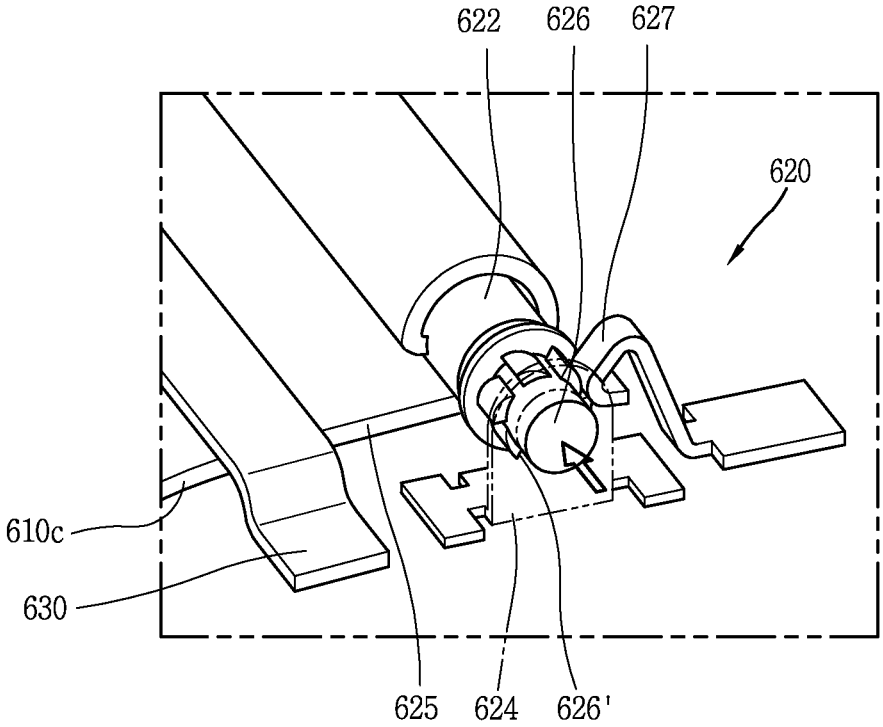
FIG. 8A is a sectional view illustrating a length control mechanism using a push button.
Figure 8B:
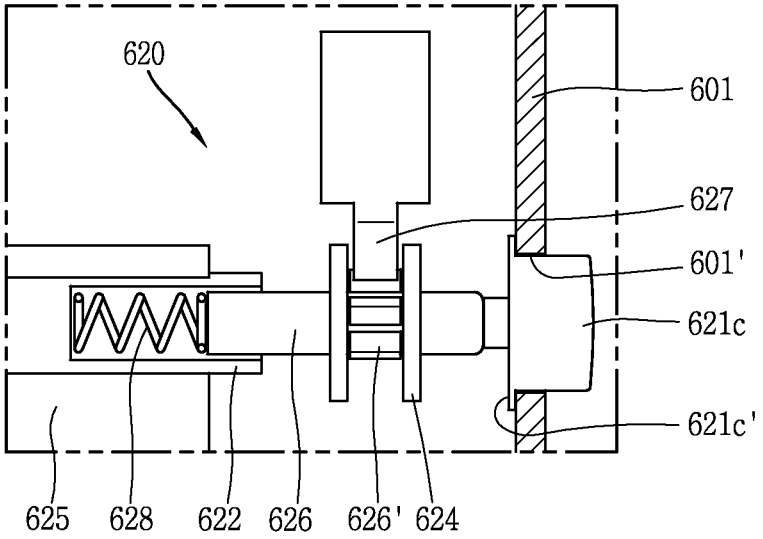
FIGS. 8B and 8C are planar views illustrating states before and after length control using a push button, respectively.
Figure 8C:
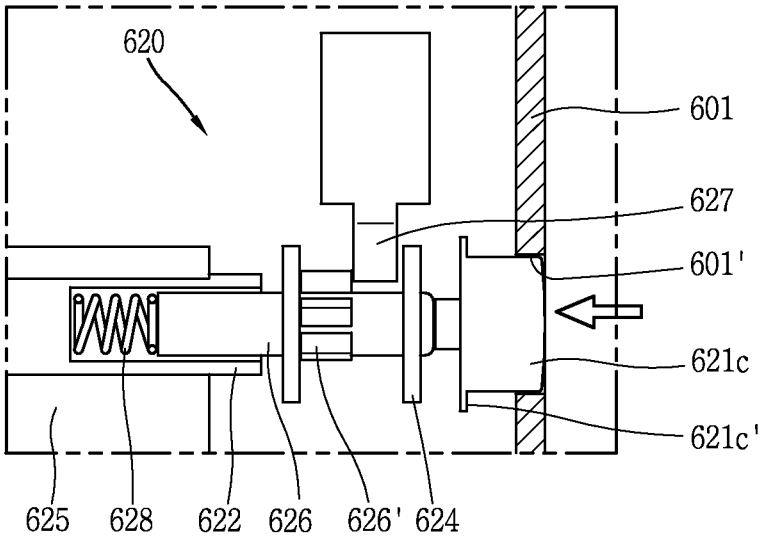

FIG. 7 illustrates a length control mechanism using the stopping portion 621*b*, and FIGS. 8A to 8C illustrate a length control mechanism using the push button 621*c*.

FIG. 7 is a sectional view illustrating a length control mechanism using the stopping portion 621*b*. The length control unit 620 includes a gear bar 622, a spiral spring 625 and a stopping portion 621*b*.

As aforementioned, the gear bar 622 is rotatably installed in the body 601. The gear bar 622 is connected to a second band 620*c*, so as to wind or unwind the second band 610*c* thereon or therefrom. However, the gear bar 622 is not directly connected to the second band 610*c*. That is, the gear bar 622 is connected to the second band 610*c* by the spiral spring 625.

The spiral spring 625 is connected to the second band 610*c* and the gear bar 622, respectively. Referring to FIG. 7, one end of the spiral spring 625 is connected to the second band 610*c*, and may be moved together with the second band 610*c*. Further, another end of the spiral spring 625 is connected to the gear bar 622, and may be wound on or unwound from the gear bar 622 as the gear bar 622 is rotated.

The spiral spring 625 has an elastic force. The spiral spring 625 may be transformed from an initial state when an external force is applied thereto, and may return to the initial state when the external force is removed therefrom. The initial state of the spiral spring 625 is set as a wound state on the gear bar 622. When an external force is applied to the spiral spring 625, the spiral spring 625 is unwound from the gear bar 622, and the gear bar 622 is rotated together with the spiral spring 625. For length control of the band unit 610, the spiral spring 625 is unwound from the gear bar 622 by a force to pull the second band 610*c*, and is wound on the gear bar 622 when the force to pull the second band 610*c* is removed.

The stopping portion 621*b* is formed to be pushable by being exposed to outside of the bodies 601*a*, 601*b* or the band unit 610. The stopping portion 621*b* presses the second band 610*c* when pushed by an external force, thereby restricting movement of the second band 610*c*.

If a user pulls the second band 610*c* in a state where the stopping portion 621*b* has not been pushed, the gear bar 622 is rotated, so that the spiral spring 625 wound on the gear bar 622 is unwound from the gear bar 622. The second band 610*c* connected to the spiral spring 625 is withdrawn from first bands 610*a*, 610*b*, and the length of the band unit 610 is increased.

If a user releases a pulled state of the second band 610*c* by his or her hand after positioning the watch type mobile terminal 600 on his or her wrist, the spiral spring 625 is wound on the gear bar 622 by a restoration force thereof. The second band 610*c* connected to the spiral spring 625 is inserted into the body 601, and the length of the band unit 610 is decreased.

In this case, if the user presses the stopping portion 621*b*, the stopping portion 621*b* presses the second band 610*c* while being inserted into the body 601. Thus, movement of the second band 610*c* being inserted into the body 601 is restricted by the stopping portion 621*b*.

The stopping portion 621*b* may be formed to be fixed in a pressed state when pressed once, and to return to the original state when pressed once again. The stopping portion 621*b* maintains a state of pressing the second band 610*c*, until a user re-presses the stopping portion 621*b*. If a user re-presses the stopping portion 621*b*, the stopping portion 621*b* which was pressing the second band 610*c* becomes distant from the second band 610*c*. Thus, the restricted state of the second band 610*c* by the stopping portion 621*b* is released. A user may increase the length of the band unit 610 by pulling the second band 610*c*, and may take off the watch type mobile terminal 600 worn on the wrist.

FIG. 8A is a sectional view illustrating a length control mechanism using the push button 621*c*.

Controlling the length of the band unit 610 by the spiral spring 625 will not be explained, since it has been aforementioned.

The length control unit 620 includes a stopping gear 626 and a locking portion 627.

The stopping gear 626 is connected to the gear bar 622 so as to be rotated together with the gear bar 622. One end of the stopping gear 626 may be connected to the gear bar 622, and another end thereof may be mounted to a mounting plate 624. The another end of the stopping gear 626 is mounted to the mounting plate 624 in a relatively-rotatable manner.

A rotational shaft of the stopping gear 626 may be the same as a rotational shaft of the gear bar 622. The second band 610*c* is connected to the spiral spring 625, and the spiral spring 625 is connected to the gear bar 622. Once the spiral spring 625 is wound on the gear bar 622 by a restoration force, the gear bar 622 and the stopping gear 626 are rotated together.

The locking portion 627 is disposed to correspond to the stopping gear 626. The locking portion 627 is formed such that one part thereof protrudes from another part thereof. The locking portion 627 is locked to a protrusion portion 626' of the stopping gear 626, such that winding of the spiral spring 625 is restricted. As the one part protruding from the another part is locked to the stopping gear 626, rotation of the stopping gear 626 is restricted.

The watch type mobile terminal 600 may include a separation prevention unit 630 configured to prevent separation of the second band 610*c* or the spiral spring 625. Once an external force is applied to the stopping gear 626, the gear bar 622, the spiral spring 625, and the second band 610*c* sequentially connected to the stopping gear 626 may be separated from the original position. The separation prevention unit 630 is coupled to an inner surface of the body 601 or the band unit 610. A hole for passing the spiral spring 625 and the second band 610*c* therethrough is formed between the separation prevention unit 630 and the inner surface.

The hole serves to provide the degree of freedom to movement of the spiral spring 625 and the second band 610*c*. Unlike this, a coupling part between the inner surface and the separation prevention unit 630 restricts movement of the spiral spring 625 and the second band 610*c*. More specifically, in a case where the second band 610*c* moves as the spiral spring 625 is wound on or unwound from the gear bar 622, the separation prevention unit 630 provides the degree of freedom to movement of the spiral spring 625 and the second band 610*c*. Thus, the spiral spring 625 may be wound on or unwound from the gear bar 622 without being influenced by the separation prevention unit 630. On the other hand, if an external force is applied to the stopping gear 626 through the push button 621*c*, the separation prevention unit 630 restricts movement of the spiral spring 625 and the second band 610*c*. Thus, even if an external force is applied to the stopping gear 626 along a direction indicated by the arrow, the spiral spring 625 and the second band 610*c* are prevented from being separated from the original position.

Unless a user provides additional manipulation, the gear bar 622 maintains a stopped state by the stopping gear 626 and the locking portion 627, and the length of the band unit 610 is maintained. Changing the length of the band unit 610 by a user's manipulation will be explained with reference to FIGS. 8B and 8C.

FIGS. 8B and 8C are planar views illustrating states before and after length control using the push button 621*c*, respectively.

The length control unit 620 includes a push button 621*c* and an elastic member 628.

The push button 621*c* is formed at the body 601 or the band unit 610 so as to be pushable. At least one hole 601' is formed at the body 601 or the band unit 610, and at least part of the push button 621*c* may be exposed to outside through the hole 601'. Alternatively, the push button 621*c* may be disposed at an inner side of the hole 601'. In this case, an object may be inserted through the hole 601' to push the push button 621*c*. Since the push button 621*c* is provided with locking jaws at two sides thereof, separation of the push button 621*c* toward outside through the hole may be prevented.

Once the push button 621*c* is pushed by an external force, it moves the stopping gear 626 so as to separate the stopping gear 626 from the locking portion 627. The stopping gear 626 may be formed so that at least part thereof can be inserted into the gear bar 622. When the stopping gear 626 is pushed by the push button 621*c*, it is inserted into the gear bar 622.

For support of the stopping gear 626, the elastic member 628 is disposed on an opposite side to the push button 621*c*, on the basis of the stopping gear 626. The elastic member 628 may provide a restoration force to the push button 621*c*, since it has an elastic force. Upon removal of the external force applied to the push button 621*c*, the elastic member 628 returns the stopping gear 626 to the original position prior to movement using a restoration force.

FIG. 8B illustrates a state before the push button 621*c* is pushed. Referring to FIG. 8B, the protrusion portion 626' of the stopping gear 626 is locked to the locking portion 627. Rotation of the stopping gear 626 is restricted by the locking portion 627. The gear bar 622 is not rotated when the stopping gear 626 is not rotated, because the stopping gear 626 and the gear bar 622 are rotated together. Also, the spiral spring 625 connected to the gear bar 622 maintains its current state, without being wound on or wound from the gear bar 622.

Referring to FIG. 8C, the protrusion portion 626' of the stopping gear 626 is separated from the locking portion 627, in a pushed state of the push button 621*c*. The push button 621*c* inserted into the body 601 pushes the stopping gear 626 along a direction of an arrow. The stopping gear 626 is inserted into the gear bar 622. If the external force applied to the push button 621*c* is removed, the stopping gear 626 may return to a position where it is locked by the locking portion 627, by a restoration force provided from the elastic member 628.

As the stopping gear 626 is inserted into the gear bar 622, its locked state by the locking portion 627 is released. And the spiral spring 625 is wound on the gear bar 622 by its elastic force. As the spiral spring 625 is wound on the gear bar 622, the second band 610*c* is inserted into the body 601 along the spiral spring 625. The length of the band unit 610 is continuously decreased until an external force to push the push button 621*c* is removed.

The stopping gear 626 and the gear bar 622 are rotated together, and the stopping gear 626 is formed to be insertable into the gear bar 622. For instance, a guide groove (not shown) configured to accommodate therein at least part of the stopping gear 626 may be formed on an inner circumferential surface of the gear bar 622, and a guide protrusion portion (not shown) inserted into the guide groove may be formed on an outer circumferential surface of the stopping gear 626. Alternatively, a guide groove (not shown) may be formed on an outer circumferential surface of the stopping gear 626, and a guide protrusion portion may be formed on an inner circumferential surface of the gear bar 622. The stopping gear 626 may be inserted into the gear bar 622 along a rotational shaft of the gear bar 622, by the guide protrusion portion inserted into the guide groove. Further, since the guide groove extends along the rotational shaft of the gear bar 622, the stopping gear 626 may be rotated together with the gear bar 622 when the gear bar 622 is rotated.

Figure 9A:
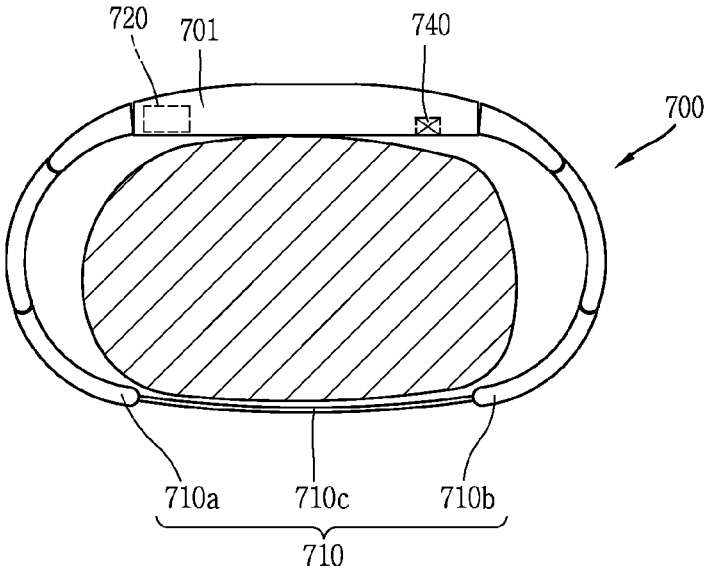
FIGS. 9A and 9B are side sectional views of a watch type mobile terminal according to another embodiment of the present invention.
Figure 9B:
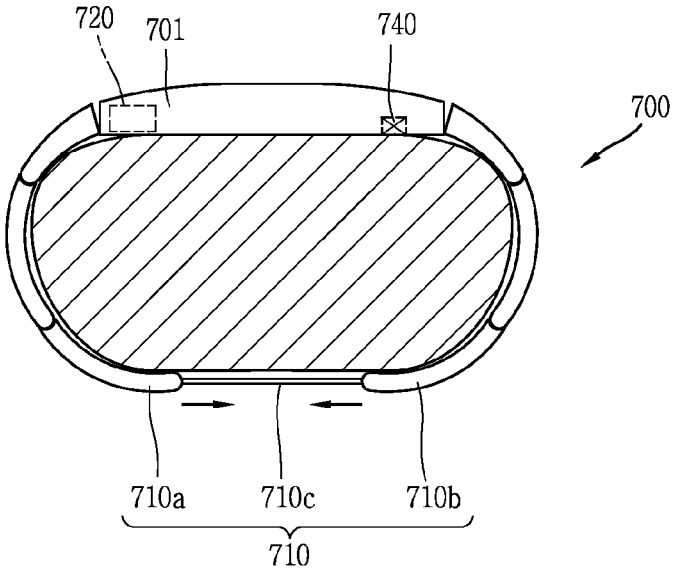

FIGS. 9A and 9B are side sectional views of a watch type mobile terminal 700 according to another embodiment of the present invention.

The watch type mobile terminal 700 includes a proximity illumination sensor 740 installed on a rear surface of a body 701 or one surface of a band unit 710. The proximity illumination sensor 740 is disposed to face a user's wrist when the user has worn the mobile terminal 700 on the wrist.

A length control mechanism to be explained in this embodiment is a sensor type of mechanism.

The proximity illumination sensor 740 has both a proximity sensor function and an illumination sensor function by a user. The proximity illumination sensor 740 may be provided with a proximity sensor and an illumination sensor, respectively. The proximity illumination sensor 740 is configured to sense change of a distance between itself and a user's wrist, and change of illumination. A motor 523 (refer to FIG. 4) installed in the body 701 may be rotated or stopped based on the distance sensed by the proximity illumination sensor 740. The motor 523 will not be explained, since it has been aforementioned in FIG. 4.

Referring to FIG. 9A, a distance between the proximity illumination sensor 740 and a user's wrist is longer than that of FIG. 9B. In this case, the motor 523 is rotated to a direction for reducing a length of the band unit 710. Referring to FIG. 9B, as the length of the band unit 710 is reduced, the distance between the proximity illumination sensor 740 and a user's wrist is shortened. In this case, the rotation of the motor 523 is automatically stopped.

The controller 180 (refer to FIG. 1) may be configured to control rotation of the motor 523, based on the distance change sensed by the proximity illumination sensor 740. Upon detection of the distance change by the proximity illumination sensor 740, the length of the band unit 710 may be controlled in correspondence to a user's wrist, without a user's additional manipulation.

Figure 10:
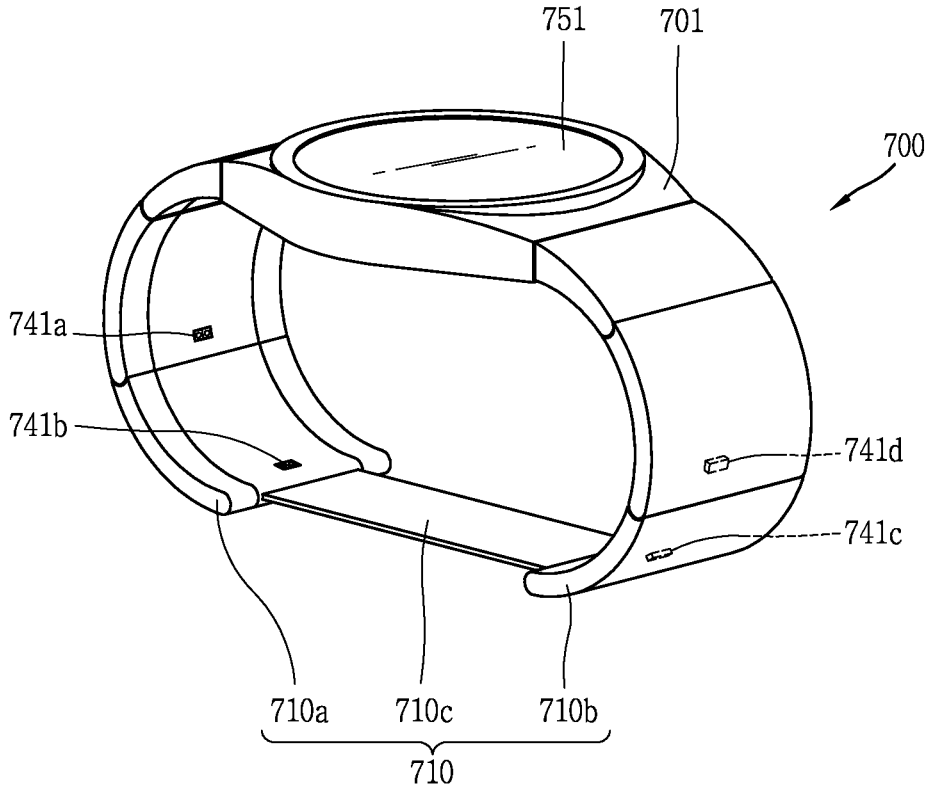
FIG. 10 is a perspective view of a watch type mobile terminal including various types of sensors.

FIG. 10 is a perspective view of the watch type mobile terminal 700 including various types of sensors.

Various types of sensors 741*a*, 741*b*, 741*c*, 741*d* rather than the proximity illumination sensor 740 for controlling the length of the band unit 710 may be installed at the watch type mobile terminal 700. For instance, a bio sensor 741*a* for sensing a user's bio-information may be installed on a rear surface of the body 701 or one surface of the band unit 710. The user's bio-information may be a heart rate, a body temperature, a blood pressure, etc.

The bio sensor 741*a* may interwork with an operation of a length control unit 720. For this, the bio sensor 741*a* is preferably arranged to face a user's body as length control of the band unit 710 by the length control unit 720 is completed. For instance, if the bio sensor 741*a* is positioned on a user's wrist within a range where a user's bio information can be measured, as the length of the band unit 710 is reduced by rotation of the motor 523, the bio sensor 741*a* may immediately measure a user's bio information. Then, the bio sensor 741*a* may output the measured user's bio information to a display unit 751 of the watch type mobile terminal 700.

A position of the bio sensor 741*a* is not limited. However, the bio sensor 741 is preferably installed on a region where it is not viewed from outside when a user has worn the watch type mobile terminal 700 on his or her wrist.

In the aforementioned embodiment, the watch type mobile terminal 700 including a single body 701 has been explained.

Hereinafter, a watch type mobile terminal having a length control unit on an additional body will be explained.

Figure 11:
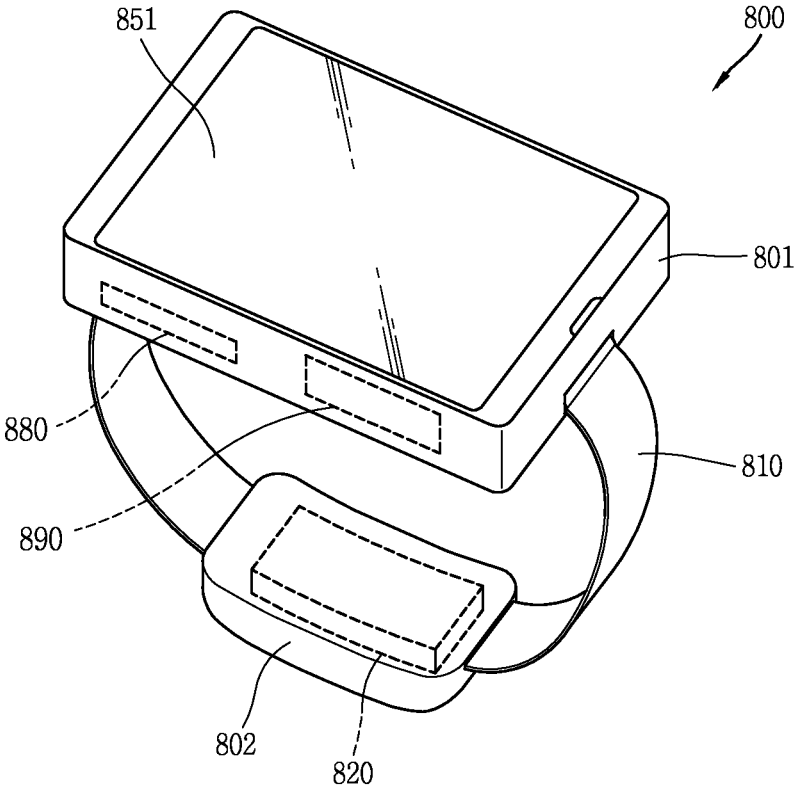
FIG. 11 is a perspective view of a watch type mobile terminal according to another embodiment of the present invention.

FIG. 11 is a perspective view of a watch type mobile terminal 800 according to another embodiment of the present invention.

Bodies 801 and 802 include a first body 801 and a second body 802.

The first body 801 is provided with a display unit 851. The display unit 851 provides a user with visual information. Electronic components for operating the watch type mobile terminal 800 may be installed in the first body 801. For instance, electronic components such as a display panel (not shown), a receiver (not shown), a printed circuit board (PCB, controller, 880) and a battery (power supply unit, 890), may be installed in the first body 801.

The second body 802 is connected to the first body 801 by a band unit 810. The second body 802 is provided with a length control unit (not shown). Electronic components for implementing the length control unit may be installed in the second body 802.

At least part of the band unit 810 may be formed of a conductive material, such that the electronic components inside the first body 801 are electrically connected to the electronic components inside the second body 802. The first body 801 and the second body 802 may transmit and receive an electric signal to/from each other, through the band unit 810. Power may be transmitted to the second body from the battery installed in the first body 801, through the band unit 810.

A non-conductive material is coated on the surface of the band unit 810. If the band unit 810 is formed of only a conductive material, electricity may flow to a user since the human body is conductible. This may cause the watch type mobile terminal 800 to malfunction. Such a problem may be overcome by coating the surface of the band unit 810 with a non-conductive material.

The length control unit 820 is installed in the second body 802, and a detailed structure thereof will be explained with reference to the following drawings.

Figure 12A:
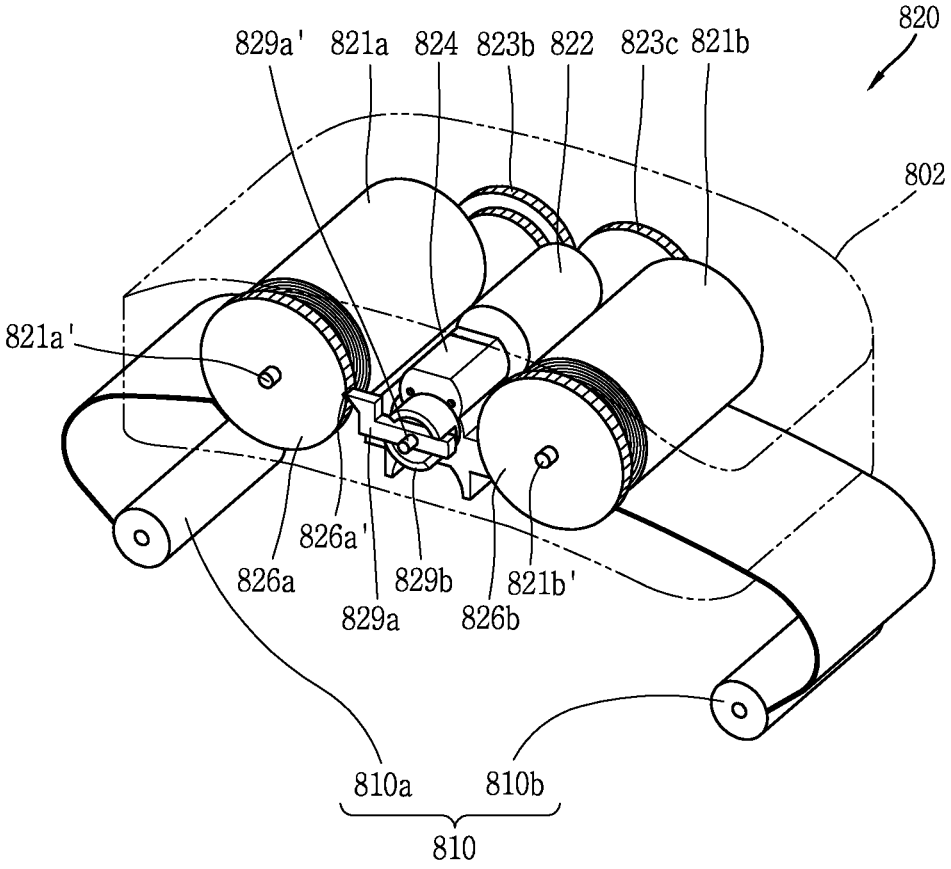
FIGS. 12A to 12C are conceptual views illustrating an inner structure of a second body, respectively, which are viewed from different directions.
Figure 12B:
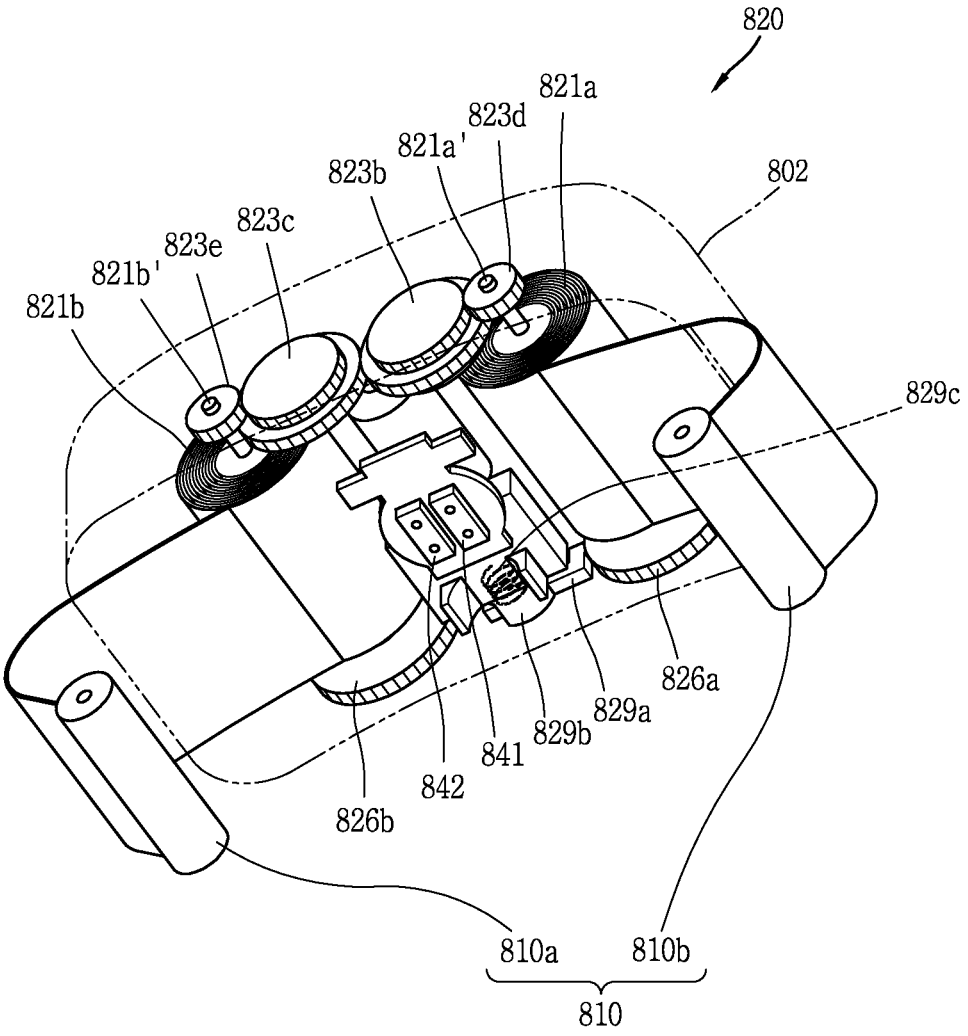
Figure 12C:
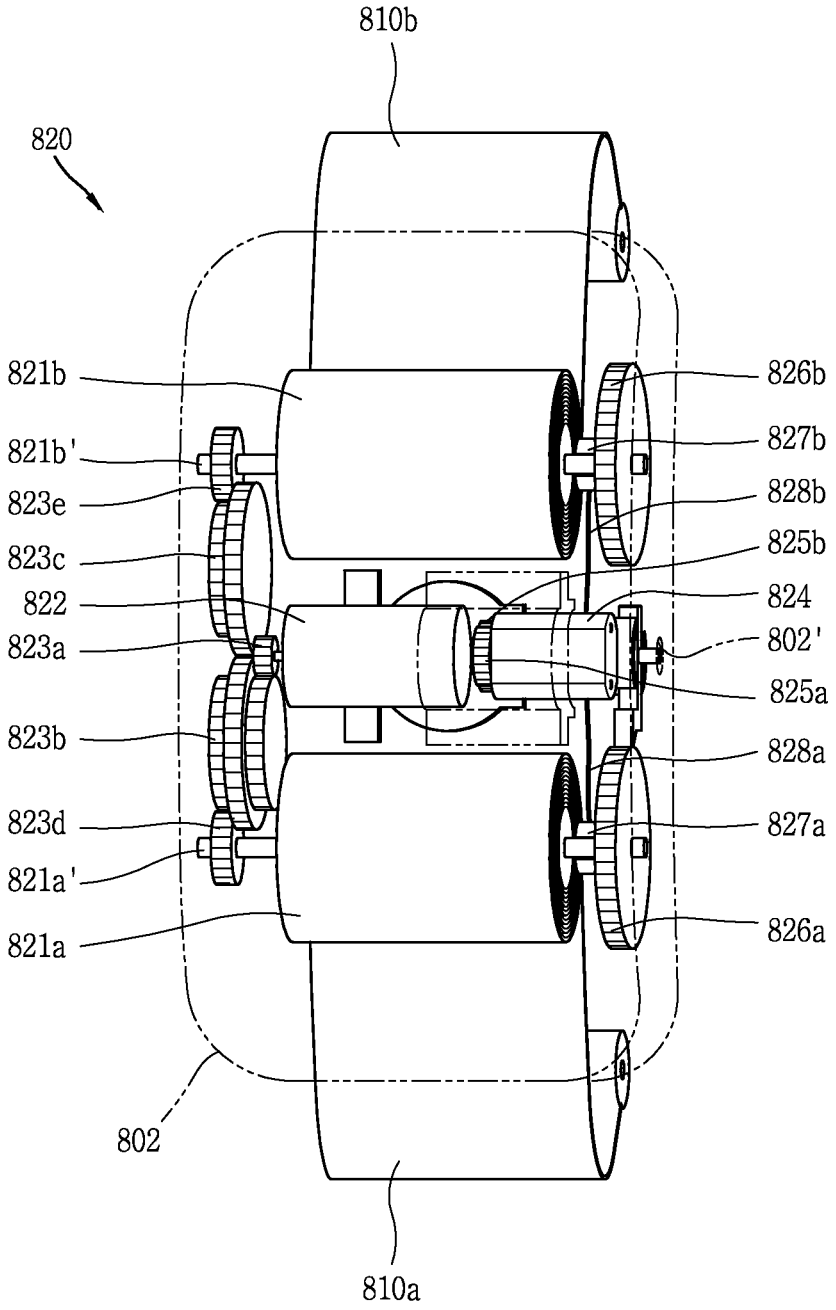

FIGS. 12A to 12C are conceptual views illustrating an inner structure of the second body 802, respectively, which are viewed from different directions.

Components installed in the second body 802 are configured to control a length of the band unit 810. Spiral springs 821*a*, 821*b* are rotatably installed in the second body 802. As shown, the spiral springs 821*a*, 821*b* may be provided in two. One 821*a* of the two spiral springs 821*a*, 821*b* is connected to a first band 810*a*, and another 821*b* thereof is connected to a second band 810*b*.

The band unit 810 is connected to the spiral springs 821*a*, 821*b*, as one end thereof is connected to the first body 801 and anther end thereof is inserted into the second body 802. The first band 810*a* and the second band 810*b* may be formed in a symmetrical manner. The spiral springs 821*a*, 821*b* have a restoration force to be wound when unwound. Thus, if the restoration force of the spiral springs 821*a*, 821*b* is controlled, the length of the band unit 810 may be controlled.

Controlling the restoration force of the spiral springs 821*a*, 821*b* may be categorized into controlling winding of the spiral springs 821*a*, 821*b*, and controlling unwinding of the spiral springs 821*a*, 821*b*. Hereinafter, a structure to control winding and unwinding of the spiral springs 821*a*, 821*b* will be explained.

Firstly, winding of the spiral springs 821*a*, 821*b* will be explained. Winding gears 823*b*, 823*c* are rotated by being engaged with gears 821*d*, 821*e* installed at rotational shafts 821*a*', 821*b*' of the spiral springs 821*a*, 821*b*, so as to be rotated together with the spiral springs 821*a*, 821*b*. The winding gears 823*b*, 823*c* receive a rotational force from a winding motor 822.

The winding motor 822 provides a rotational force to the winding gears 823*b*, 823*c*. A gear 823*a*, installed at a rotational shaft of the winding motor 822, is rotated by being engaged with the winding gears 823*b*, 823*c*. The winding motor 822 and the winding gears 823*b*, 823*c* are configured to rotate the two spiral springs 821*a*, 821*b*, to different directions. Thus, the two spiral springs 821*a*, 821*b* are rotated to different directions, by a rotational force provided from the winding motor 822. When the length of the band unit 810 is increased, the first band 810*a* and the second band 810*b* are withdrawn from the second body 802. On the other hand, when the length of the band unit 810 is decreased, the first band 810*a* and the second band 810*b* are inserted into the second body 802.

Next, unwinding of the spiral springs 821*a*, 821*b* will be explained. If unwinding of the spiral springs 821*a*, 821*b* is controlled, the watch type mobile terminal 800 may maintain its fixed state onto a user's wrist.

Unwinding gears 826*a*, 826*b* are installed at rotational shafts 821*a*', 821*b*' of the spiral springs 821*a*, 821*b*, so as to be rotated together with the spiral springs 821*a*, 821*b*. The unwinding gears 826*a*, 826*b* are provided with a groove 826*a*' on an outer circumferential surface.

A locking member 829*a* is formed to be rotatable. The locking member 829*a* may be disposed between the two unwinding gears 826*a*, 826*b*. At least part of the locking member 829*a* may protrude from a rotational shaft 829*a*' of the locking member 829*a*, toward one of the unwinding gears 826*a*, 826*b*. The locking member 829*a* is inserted into the groove 826*a*' of the unwinding gears 826*a*, 826*b*, within a preset range of rotation angle, such that rotation of the spiral springs 821*a*, 821*b* is restricted.

A housing 829*b* is formed to enclose at least part of the locking member 829*a*. The housing 829*b* accommodates the locking member 829*a*. In this case, the locking member 829*a* is partially accommodated in the housing 829*b*. The housing 829*b* is formed to set a rotation angle of the locking member 829*a*. The locking member 829*a* is rotatable centering around the rotational shaft, in an accommodated state in the housing 829*b*. However, rotation of the locking member 829*a* with an angle more than a predetermined angle is restricted by the housing 829*b*.

An unwinding motor 824 is connected to the rotational shaft 829*a*' of the locking member 829*a* so as to rotate the locking member 829*a*. The unwinding motor 824 and the rotational shaft 829*a*' of the locking member 829*a* may be connected to each other by gears 825*a*, 825*b*. The locking member 829*a* is rotated by a rotational force provided from the unwinding motor 824.

In a state where the locking member 829*a* has been inserted into the groove 826*a*' of the unwinding gear 826*a*, rotation of the unwinding gear 826*a* is restricted. If rotation of the unwinding gear 826*a* is restricted, rotation of the two spiral springs 821*a*, 821*b* is also restricted. Thus, the band unit 810 may maintain a fixed length, and the watch type mobile terminal 800 may be fixed onto a user's wrist. If the unwinding motor 824 is rotated, the locking member 829*a* connected to the unwinding motor 824 is also rotated within the housing 829*b*, by various types of gears. In this case, the locking member 829*a* may be separated from the groove 826*a*' of the unwinding gear 826*a*.

Once the locking member 829*a* is separated from the groove 826*a*' of the unwinding gear 826*a*, the spiral springs 821*a*, 821*b* connected to the unwinding gears 826*a*, 826*b* may be rotated. As a result, if the band unit 810 is in a length controllable state, the length of the band unit 810 may be controlled by the winding gears 823*b*, 823*c* and the winding motor 822.

The watch type mobile terminal 800 may include the winding motor 822 and the unwinding motor 824, respectively. Alternatively, the watch type mobile terminal 800 may include a single motor for controlling winding and unwinding of the band unit 810. Since the winding motor 822 and the unwinding motor 824 are operated by power supplied from a battery (not shown), etc., they should be electrically connected to a battery 890 inside the first body 801. For this, a length control unit 820 further includes supporting portions 827*a*, 827*b* and cables 828*a*, 828*b*.

The supporting portions 827*a*, 827*b* are formed to contact the rotational shafts of the spiral springs 821*a*, 821*b*. The spiral springs 821*a*, 821*b* supported by the supporting portions 827*a*, 827*b* may maintain a contacted state to the supporting portions 827*a*, 827*b*. The rotational shafts of the spiral springs 821*a*, 821*b* may be rotated in a supported state by the supporting portions 827*a*, 827*b*. At least part of the supporting portions 827*a*, 827*b* may be formed of a conductive material for electrical connection.

Cables 828*a*, 828*b* may be electrically connected to the winding motor 822 or the unwinding motor 824 and the supporting portions 827*a*, 827*b*, such that an electric signal transmitted from the first body 801 through the band unit 801 is provided to the winding motor 822 or the unwinding motor 824. The electric signal includes power. An electric signal generated from inside of the first body 801 may be transmitted to the winding motor 822 or the unwinding motor 824, through the band unit 810, the spiral springs 821*a*, 821*b*, the rotational shafts 821*a*', 821*b*', the supporting portions 827*a*, 827*b*, and the cables 828*a*, 828*b*. The winding motor 822 and the unwinding motor 824 may be rotated by an electric signal transmitted thereto through the cables 828*a*, 828*b*.

The unwinding motor 824 may malfunction due to failure of transmission of an electric signal, etc. If the winding motor 822 is not smoothly operated, a user's inconvenience is not caused. Because it means that the watch type mobile terminal 800 is not merely wearable on the human body. However, if the unwinding motor 824 is not smoothly operated, a user's inconvenience is caused. Because it means that a user cannot take off the watch type mobile terminal 800 worn on his or her wrist.

In such a case requiring for an urgent handling, unwinding of the spiral springs 821*a*, 821*b* may be controlled by using the following structure.

The second body 802 is provided with a hole 802' corresponding to the locking member 829*a*. The locking member 829*a* may be separated from the groove 826*a*' of the unwinding gear 826*a*, by being pressed by an external object inserted through the hole 802'. In this case, the separation of the locking member 829*a* does not mean rotation due to an operation of the unwinding motor 824. More specifically, the locking member 829*a* is moved to a direction parallel to the rotational shafts 821*a*', 821*b*' of the spiral springs 821*a*, 821*b*, by the external object, thereby being separated from the groove 826*a*'.

The locking member 829*a* may be supported by an elastic member 829*c*. The elastic member 829*c* is disposed at an opposite side to the hole 802' on the basis of the locking member 829*a*, thereby supporting the locking member 829*a*. The elastic member 829*c* may restore the locking member 829*a* to the original position prior to movement, due to its restoration force, when the external force by the external object is removed.

Various sensors 841, 842 may be installed at the second body 802. Explanations about the sensors 841, 842 are replaced by the aforementioned descriptions.

The present invention may have the following advantages.

Firstly, since the length of the band unit is controllable in accordance with a user's body size, a user's inconvenience caused when a user wears the watch type mobile terminal can be minimized.

Further, since various types of length control mechanisms are provided, an optimum mechanism can be selected for enhanced convenience of a user who wears the watch type mobile terminal.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A watch type mobile terminal, comprising:

a body having a power supply unit, a printed circuit board, and a display unit formed to implement a touch input thereon;

a band unit formed to be wearable on a user's wrist by being connected to the body, and formed such that at least part thereof is wound or unwound in the body; and a length control unit configured to implement winding or unwinding of the band unit such that a length of the band unit is controllable in accordance with a user's wrist size.

2. The watch type mobile terminal of claim 1, wherein the length control unit further includes a stopping portion formed to be pushable by being exposed to outside of the body or the band unit, and wherein the stopping portion is configured to press the second band when pushed by an external force, to thus restrict movement of the second band.

3. The watch type mobile terminal of claim 1, further comprising a bio sensor installed on a rear surface of the body or one surface of the band unit, and configured to sense a user's bio information, wherein the bio sensor is arranged to face a user's body as length control of the band unit by the length control unit is completed.

4. The watch type mobile terminal of claim 1, wherein the length control unit further includes a gear bar rotatably installed in the body, the gear bar connected to the second band so as to wind or unwind the second band thereon or therefrom according to a rotation direction thereof.

5. The watch type mobile terminal of claim 4, further comprising a flexible printed circuit board electrically connected to electronic components inside the body, and extending up to inside of the first band, wherein the length control unit further includes a push switch formed to be pushable as at least part thereof is exposed to outside of the band unit, and wherein the push switch is electrically connected to the flexible printed circuit board, and generates a signal to wind or unwind the second band according to a push input.

6. The watch type mobile terminal of claim 4, wherein the length control unit further includes a motor connected to a rotational shaft of the gear bar so as to rotate the gear bar.

7. The watch type mobile terminal of claim 6, wherein the motor is rotated or stopped based on a user's input, such that a length of the band unit is controllable to a preset length.

8. The watch type mobile terminal of claim 6, further comprising a proximity illumination sensor installed on a rear surface of the body, wherein the motor is rotated or stopped based on change of a distance between a user's wrist and the body, the distance change sensed by the proximity illumination sensor.

9. The watch type mobile terminal of claim 4, wherein the length control unit further includes a spiral spring connected to the second band and the gear bar, respectively, and wherein for length control of the band unit, the spiral spring is unwound from the gear bar by a force to pull the second band, and is wound on the gear bar when the force to pull the second band is removed.

10. The watch type mobile terminal of claim 9, wherein the length control unit includes:

a stopping gear rotated together with the gear bar;

a locking portion disposed to correspond to the stopping gear, and formed to be locked to the stopping gear such that re-winding of the spiral spring is restricted;

a push button formed at the body or the band unit so as to be pushable, and configured to move the stopping gear so as to separate the stopping gear from the locking portion, when it is pushed by an external force; and an elastic member disposed on an opposite side to the push button on the basis of the stopping gear, for support of the stopping gear, the elastic member configured to return the stopping gear to an initial position prior to movement when the external force applied to the push button is removed.

11. The watch type mobile terminal of claim 1, wherein the body includes:

a first body having the power supply unit, the printed circuit board and the display unit; and a second body connected to the first body by the band unit, and having the length control unit.

12. The watch type mobile terminal of claim 11, wherein the length control unit includes at least one spiral spring rotatably installed in the second body, and wherein one end of the band unit is connected to the first body (801), and another end of the band unit is inserted into the second body to thus be connected to the spiral spring.

13. The watch type mobile terminal of claim 12, wherein at least part of the band unit is formed of a conductive material, such that electronic components inside the first body are electrically connected to electronic components inside the second body, and wherein a non-conductive material is coated on a surface of the band unit.

14. The watch type mobile terminal of claim 13, wherein the length control unit further includes:

a winding gear connected to a rotational shaft of the spiral spring, so as to be rotated together with the spiral spring; and a winding motor connected to the winding gear so as to provide a rotational force to the winding gear.

15. The watch type mobile terminal of claim 14, wherein the length control unit further includes:

a supporting portion formed to contact the rotational shaft of the spiral spring, and formed of a conductive material partially or wholly; and a cable electrically connected to the winding motor and the supporting portion, such that an electric signal transmitted from the first body through the band unit is provided to the winding motor, and wherein the winding motor is rotated based on an electric signal transmitted through the cable.

16. The watch type mobile terminal of claim 13, wherein the length control unit includes:

an unwinding gear installed at the rotational shaft of the spiral spring, so as to be rotated together with the spiral spring, and having a groove on an outer circumferential surface thereof;

a locking member formed to be rotatable, and inserted into the groove with a preset range of rotation angle, such that rotation of the spiral spring is restricted; and an unwinding motor connected to a rotational shaft of the locking member so as to rotate the locking member.

17. The watch type mobile terminal of claim 16, wherein the length control unit further includes:

a supporting portion formed to contact the rotational shaft of the spiral spring, and formed of a conductive material partially or wholly; and a cable electrically connected to the unwinding motor and the supporting portion, such that an electric signal transmitted from the first body through the band unit is provided to the unwinding motor, and wherein the unwinding motor is rotated based on an electric signal transmitted through the cable.

18. The watch type mobile terminal of claim 16, wherein the second body is provided with a hole corresponding to the locking member, wherein the locking member is separated from the groove by being pressed by an external object inserted through the hole, and wherein the length control unit further includes an elastic member disposed at an opposite side to the hole on the basis of the locking member, for support of the locking member, the elastic member configured to restore the locking member to an initial position prior to movement when the external force by the external object is removed.

* * * * *